US006401256B1

(12) United States Patent
Shreve

(10) Patent No.: US 6,401,256 B1
(45) Date of Patent: Jun. 11, 2002

(54) ORTHOPEDIC SOCK SYSTEM

(76) Inventor: Lee P. Shreve, 4512 Aviemore Crescent, Raleigh, NC (US) 27604

( * ) Notice: Subject to any disclaimer, the term of this patent is extended or adjusted under 35 U.S.C. 154(b) by 0 days.

(21) Appl. No.: 09/838,756

(22) Filed: Apr. 19, 2001

(51) Int. Cl.[7] ..... A63B 31/08
(52) U.S. Cl. ..... 2/239; 441/64
(58) Field of Search ..... 2/239, 240, 241, 2/242; 482/105; 36/132; 441/64

(56) References Cited

U.S. PATENT DOCUMENTS 4,384,369 A * 5/1983 Prince ..... 2/79
4,541,810 A * 9/1985 Wenzel ..... 441/64
4,777,743 A * 10/1988 Roehrig, Jr. ..... 36/132
4,838,546 A * 6/1989 Winston ..... 272/119
4,997,183 A * 3/1991 Winston ..... 272/119
5,027,440 A * 7/1991 Morris et al. ..... 2/239
5,108,328 A * 4/1992 Hull ..... 441/64
5,133,091 A * 7/1992 del Valle Mas ..... 2/239
5,266,062 A * 11/1993 Runckel ..... 441/64
5,447,457 A * 9/1995 Kamitani ..... 441/64
5,542,896 A * 8/1996 Qaiesi et al. ..... 482/105
5,651,142 A * 7/1997 del Valle Mas ..... 2/239
5,664,263 A * 9/1997 Reynolds ..... 2/239
5,683,335 A * 11/1997 Groves et al. ..... 482/105
5,836,019 A * 11/1998 McCafferty ..... 2/239
6,199,216 B1 * 3/2001 Weatherspoon ..... 2/239
6,224,443 B1 * 5/2001 Mehrmann et al. ..... 441/64

* cited by examiner

*Primary Examiner*—John J. Calvert
*Assistant Examiner*—Alissa L. Hoey
(74) *Attorney, Agent, or Firm*—Joseph N. Breaux

(57) ABSTRACT

An orthopedic sock system that includes a pair of identical socks each provided with pockets at various locations on the sock that are adapted to receive and hold one of a number of user inserted weight inserts. The user may add weight inserts to each of the socks as desired to achieve the desired rehabilitative or training effect.

1 Claim, 2 Drawing Sheets

ORTHOPEDIC SOCK SYSTEM

TECHNICAL FIELD

The present invention relates to exercise and rehabilitation systems and more particularly to an orthopedic sock system including a pair of identical sock structures and a number of weight inserts; each identical sock structure including a sock portion having a foot receiving cavity in connection with a tubular leg receiving portion and a number of weight insert receiving pouches formed in connection with the sock structure; a number of weight insert receiving pouches being provided in connection with a foot top cover portion of each sock structure, a number of weight insert receiving pouches being provided in connection with an interior ankle surface covering outer portion of each sock structure, a number of weight insert receiving pouches being provided in connection with an exterior ankle surface covering outer portion of each sock structure, a number of weight insert receiving pouches being provided in connection with an above the interior ankle surface covering outer portion of each sock structure, and a number of weight insert receiving pouches being provided in connection with an above the exterior ankle surface covering outer portion of each sock structure; each weight receiving pouch being optionally provided with a hook and pile fastener mechanism for securing a respective weight insert within the weight receiving pouch; the weight inserts being positioned within user selected weight receiving pouches so as to allow a user to have increased resistance at locations on the user's foot, ankle and/or lower shin such that a rehabilitative benefit is received by the user.

BACKGROUND ART

Many individuals suffer foot, ankle and lower leg injuries that can become disabling if rehabilitative efforts are not immediately and properly instituted. One of the most effective rehabilitative methodologies is to secure weights to the limb or other area to be rehabilitated so that the muscles to be rehabilitated are forced to work harder, thereby reducing the time required to restore the injured muscles and tissues to pre-injury levels and above. Because the foot, ankle and lower shin area of the leg contain a large number of muscles that act in different directions and independently of each other, it is difficult to secure weights at locations on the foot, ankle and lower shin such that the weights provide effective resistance for rehabilitation of the injured muscles and tissues. It would be a benefit, therefore, to have a system for securing weights to particular areas of the foot, ankle and lower shin area of the leg such that particular muscles, muscle groups and tissue areas are required to support the weights.

In addition, because the addition of weight provides increased resistance to the muscles that must move the additional weight, it would be a still further benefit, to have a weight attachment system for increasing the resistance of specific muscles and muscle groups in the feet, ankle and lower shin areas of an athlete so that the athlete could more effectively increase the strength in his/her feet, ankles and lower shins.

GENERAL SUMMARY DISCUSSION OF INVENTION

It is thus an object of the invention to provide an orthopedic sock system that includes a pair of identical sock structures and a number of weight inserts; each identical sock structure including a sock portion having a foot receiving cavity in connection with a tubular leg receiving portion and a number of weight insert receiving pouches formed in connection with the sock structure; a number of weight insert receiving pouches being provided in connection with a foot top cover portion of each sock structure, a number of weight insert receiving pouches being provided in connection with an interior ankle surface covering outer portion of each sock structure, a number of weight insert receiving pouches being provided in connection with an exterior ankle surface covering outer portion of each sock structure, a number of weight insert receiving pouches being provided in connection with an above the interior ankle surface covering outer portion of each sock structure, and a number of weight insert receiving pouches being provided in connection with an above the exterior ankle surface covering outer portion of each sock structure; each weight receiving pouch being optionally provided with a hook and pile fastener mechanism for securing a respective weight insert within the weight receiving pouch; the weight inserts being positioned within user selected weight receiving pouches so as to allow a user to have increased resistance at locations on the user's foot, ankle and/or lower shin such that a rehabilitative benefit is received by the user.

Accordingly, an orthopedic sock system is provided. The orthopedic sock system includes a pair of identical sock structures and a number of weight inserts; each identical sock structure including a sock portion having a foot receiving cavity in connection with a tubular leg receiving portion and a number of weight insert receiving pouches formed in connection with the sock structure; a number of weight insert receiving pouches being provided in connection with a foot top cover portion of each sock structure, a number of weight insert receiving pouches being provided in connection with an interior ankle surface covering outer portion of each sock structure, a number of weight insert receiving pouches being provided in connection with an exterior ankle surface covering outer portion of each sock structure, a number of weight insert receiving pouches being provided in connection with an above the interior ankle surface covering outer portion of each sock structure, and a number of weight insert receiving pouches being provided in connection with an above the exterior ankle surface covering outer portion of each sock structure; each weight receiving pouch being optionally provided with a hook and pile fastener mechanism for securing a respective weight insert within the weight receiving pouch; the weight inserts being positioned within user selected weight receiving pouches so as to allow a user to have increased resistance at locations on the user's foot, ankle and/or lower shin such that a rehabilitative benefit is received by the user.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
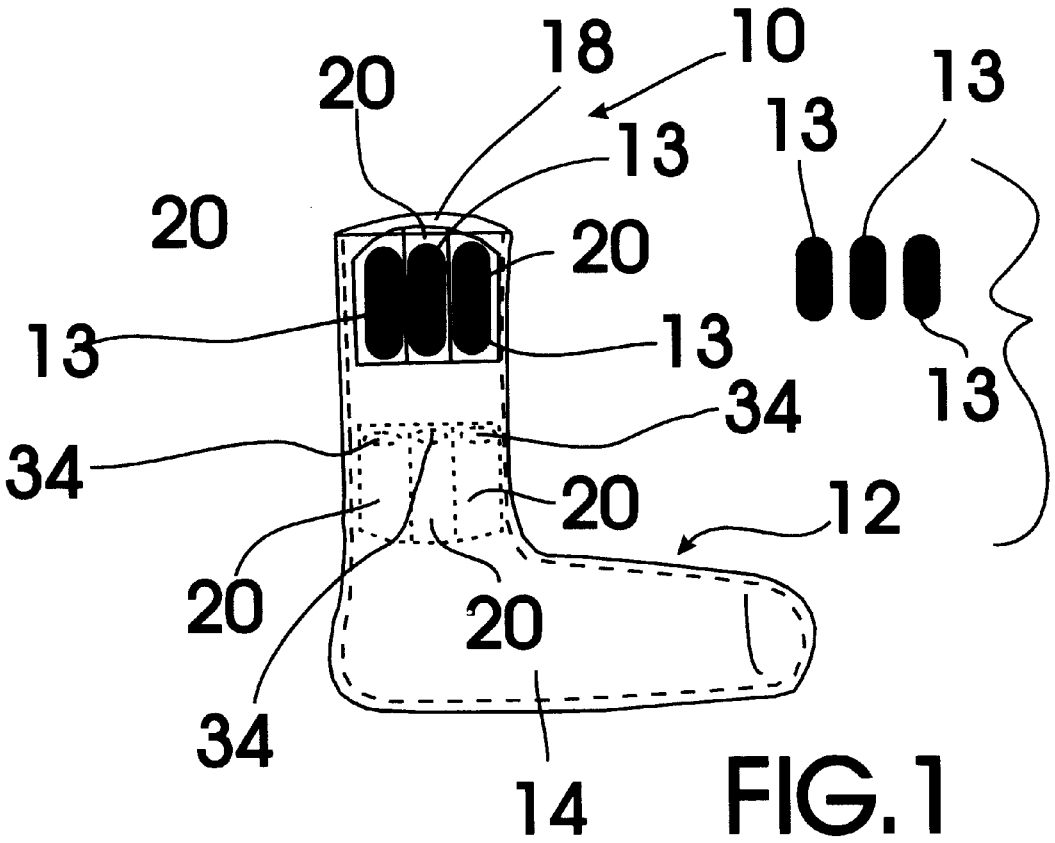
FIG. 1 is a side plan view of a first exemplary embodiment of the orthopedic sock system of the present invention.
Figure 2:
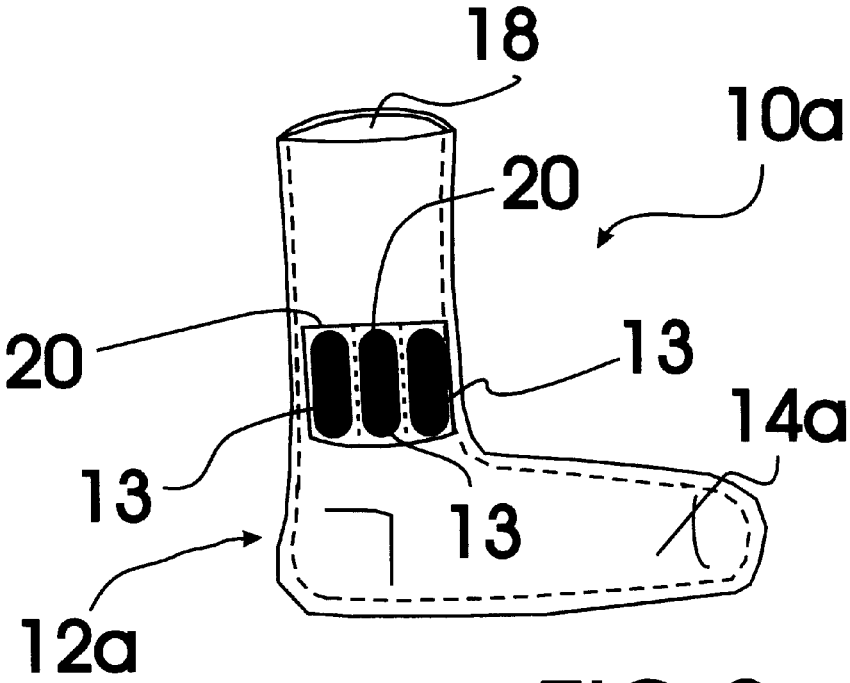
FIG. 2 is a side plan view of a second exemplary embodiment of the orthopedic sock system of the present invention.
Figure 3:
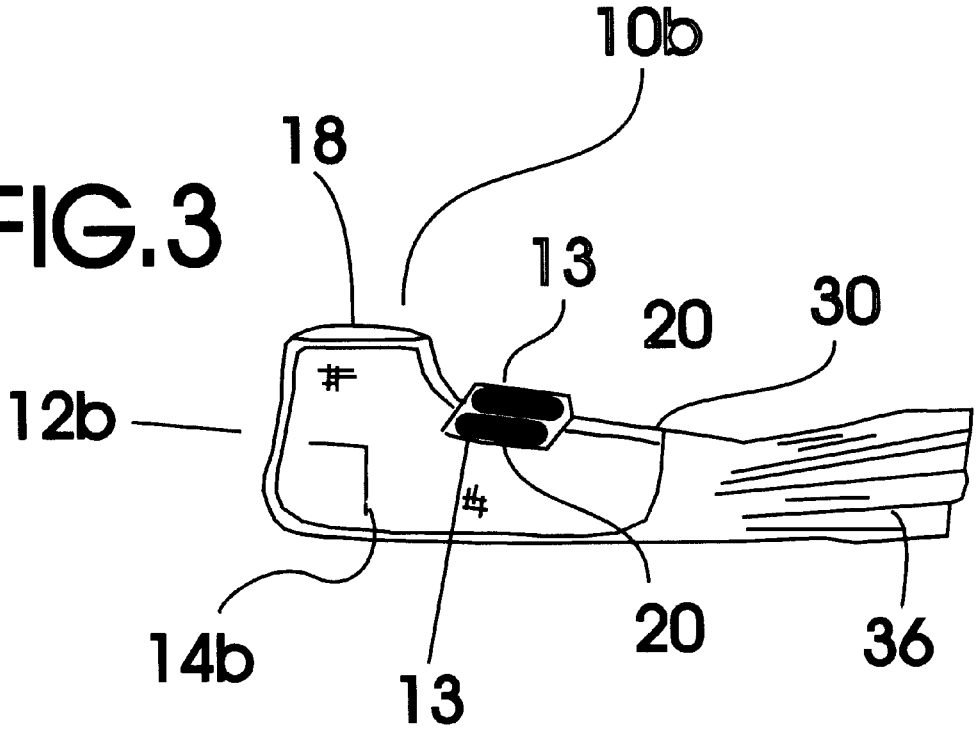
FIG. 3 is a side plan view of a third exemplary embodiment of the orthopedic sock system wherein the sock structures are formed of neoprene and a forward portion of each sock structure is provided with a swim fin to provide a user with resistance while moving his/her feet through the water.
Figure 4:
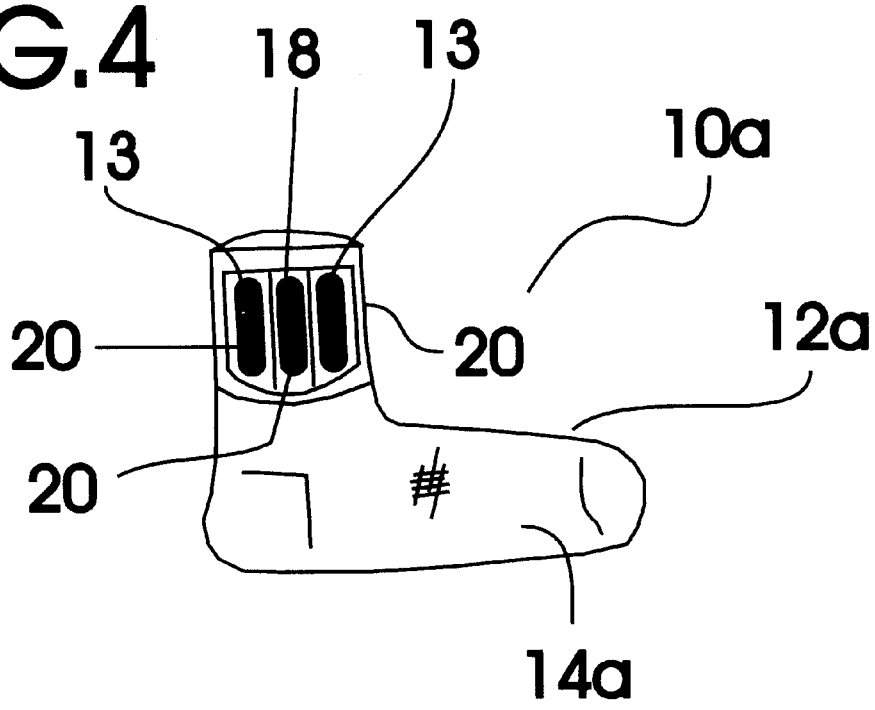
FIG. 4 is a second side plan view of the orthopedic sock system of FIG. 2 with a top lower shin covering sock structure portion folded down in a manner to cover and secure weight inserts within weight receiving pouches of the sock structure.

FIGS. 1–4 show various aspects of exemplary embodiments of the orthopedic sock system of the present invention generally designated 10, 10*a*, and 10*b*. Orthopedic sock systems 10,10*a* and 10*b* each include a pair of identical sock structures, generally designated 12,12*a* ,12*b* , respectively, and a number of weight inserts 13.

Each identical sock structure 12,1*a*,12*b* includes a sock portion 14,14*a*,14*b* having a foot receiving cavity 16 (shown in dashed lines, in connection with a tubular leg receiving portion 18 and a number of weight insert receiving pouches 20 formed in connection with the respective sock structures 12,12*a*,12*b*. Sock structure 14*b* is constructed from neoprene rubber and is provided with a number of weight insert receiving pouches 20 in connection with a foot top cover portion 30 of each sock structure 14*b* and a swim fin portion 36 at the toe end of each sock structure 14*b*.

The weight insert receiving pouches 20 of sock structure 14 are provided with hook and pile faster mechanisms 34 for keeping a respective weight insert 13 within each of the weight receiving pouches 20. In use, the user positions the weight inserts 13 into selected weight insert pouches 20 to achieve added resistance for specific muscles and muscle groups of the foot and ankle.

It can be seen from the preceding description that an orthopedic sock system has been provided.

It is noted that the embodiment of the orthopedic sock system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An orthopedic sock system comprising:

a pair of identical sock structures constructed from neoprene and having a toe end; and a number of weight inserts;

each identical sock structure including a sock portion having a foot receiving cavity in connection with a tubular leg receiving portion and weight insert receiving pouches formed in connection with the sock structure;

a weight insert receiving pouch being provided in connection with a foot top cover portion of each sock structure;

a weight insert receiving pouch being provided in connection with an interior ankle surface covering outer portion of each sock structure;

a weight insert receiving pouch being provided in connection with an exterior ankle surface covering outer portion of each sock structure;

a weight insert receiving pouch being provided in connection with an above the interior ankle surface covering outer portion of each sock structure;

a weight insert receiving pouch being provided in connection with an above the exterior ankle surface covering outer portion of each sock structure;

each weight insert receiving pouch being provided with a hook and pile fastener mechanism for securing a respective one of the number of weight inserts within the weight receiving pouch;

the number of weight inserts being positioned within user selected weight receiving pouches so as to allow a user to have increased resistance at locations on the user's foot, ankle and/or lower shin such that a rehabilitative benefit is received by the user at user selected locations;

a swim fin portion being provided at the toe end of each sock structures.

* * * * *